US007871560B2

(12) United States Patent
Best et al.

(10) Patent No.: US 7,871,560 B2
(45) Date of Patent: Jan. 18, 2011

(54) METALLURGICAL VESSEL WITH FIXING SYSTEM

(75) Inventors: Rolf Best, Gladbeck (DE); Wilhelm Köper, Duisburg (DE); Telita Moreira Köper, legal representative, Duisburg (DE); Marcel Fasswald, Ratingen (DE); Lutz Rose, Duisburg (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 11/794,013

(22) PCT Filed: Dec. 19, 2005

(86) PCT No.: PCT/EP2005/013680

§ 371 (c)(1),
(2), (4) Date: Jan. 28, 2008

(87) PCT Pub. No.: WO2006/066854

PCT Pub. Date: Jun. 29, 2006

(65) Prior Publication Data

US 2008/0111286 A1 May 15, 2008

(30) Foreign Application Priority Data

Dec. 21, 2004 (DE) ..... 10 2004 062 871

(51) Int. Cl.
*C21C 5/48* (2006.01)

(52) U.S. Cl. ..... 266/245; 266/243

(58) Field of Classification Search ..... 266/200, 266/243, 245, 246, 247
See application file for complete search history.

(56) References Cited

U.S. PATENT DOCUMENTS 3,430,941 A 3/1969 Lambrecht et al.

(Continued)

FOREIGN PATENT DOCUMENTS

| | | | |
|---|---|---|---|
| WO | 99/29912 | | 6/1999 |
| WO | WO 99/29912 | * | 6/1999 |
| WO | 2004/042091 | | 5/2004 |

OTHER PUBLICATIONS

Database WPI, Derwent Publications Ltd., London, GB; XP002401284 & SU 430 163 A (Kraizinger F V), May 30, 1974.

*Primary Examiner*—Scott Kastler
(74) *Attorney, Agent, or Firm*—Lucas & Mercanti, LLP; Klaus P. Stoffel

(57) ABSTRACT

A metallurgical vessel having support brackets mounted on a vessel wall. The support brackets are mounted by a mounting system on a support body that does not completely surround the circumference of the vessel. The mounting system includes clamps that act on the support brackets. A coupling device is provided, which has, a first coupling component designed as a male part mounted on the support body and a second coupling component designed as a female part mounted on the vessel wall. The first and second coupling components are configured and arranged so as to automatically engage when the clamps are in the engaged position and to automatically disengage when the clamps are not in the engaged position. The coupling device has sealing elements and a coupling mechanism of the first coupling component relative to the second coupling component.

11 Claims, 4 Drawing Sheets

U.S. PATENT DOCUMENTS 3,951,390 A * 4/1976 Krause et al. ..... 266/221
4,387,884 A * 6/1983 Seki et al. ..... 266/246
4,700,929 A * 10/1987 Langlitz et al. ..... 266/246
6,331,269 B1 * 12/2001 Moriceau ..... 266/207
2006/0131796 A1 * 6/2006 Schubert et al. ..... 266/240

* cited by examiner

METALLURGICAL VESSEL WITH FIXING SYSTEM

The invention concerns a metallurgical vessel, especially a converter.

Mainly AOD converters are used to produce stainless steel. In the AOD (Argon Oxygen Decarburization) process, process gases (argon, oxygen, or even nitrogen) are mixed into the molten bath. Due to the strong dynamic bath motion in the converter vessel that is associated with the process, the refractory lining of the converter is subject to strong wear, so that the converter lining must be replaced at regular intervals. To keep the converter downtime as short as possible, it is common practice to work with exchange vessels. To allow the converter to be changed, it is necessary to disconnect the vessel mounting from the trunnion ring surrounding the converter and to detach the process gas and inert gas lines.

In converters with a charge weight above about 80 tonnes, well-known mounting elements, for example, swing bolts, take on dimensions that make them difficult to handle manually due to their weight. In addition, the heat radiation from the converter and the poor and dangerous access make activity more difficult. The same is true of process gases, which are carried by flexible hoses and pipelines to the tuyeres mounted on the vessel.

After the converter has been disconnected from the trunnion ring, it is lifted out of the trunnion ring. If the building crane cannot act directly on the converter, a converter change car can be used to lift the converter in the converter stand and move it out of the U-shaped trunnion ring, i.e., out of the side of the trunnion ring that is open in the direction of travel. The trunnion ring may be cooled or uncooled. There are limits to how high the converter can be lifted, because the waste gas hood is mounted directly above the converter.

A manual operating system of the type described above is disclosed in DE 20 51 382 A1, which describes a tiltable crucible or converter with a releasable clamping device between a trunnion ring that surrounds the converter and supporting trunnions on the converter. The supporting trunnions are supported in bearing bushings that are releasably joined with the trunnion ring. The bearing boxes themselves are mounted on the support body by draw hooks, which can be swiveled in and out of an engaged position, where this draw hook connection can be manually broken and reestablished.

Furthermore, solutions are known which already create a mounting system without manual engagement in the vicinity of the converter, as described in the additional application DE 25 11 610 A1 to DE 20 51 382 A1 cited above. In particular, each supporting trunnion has a lower bearing bushing half and an upper bearing bushing bolting piece, which surround the bearing bushing of the supporting trunnions in the engaged position. The upper bearing bushing bolting piece can be swung away by a pressure medium cylinder, so that the bearing bushing is released towards the top, and the converter can be lifted from the support body. In addition, the upper side of this bearing bushing bolting piece has a fitting surface, with which the hook end of a draw hook rotatably supported on the support body can be engaged. This draw hook is moved by a separate pressure medium cylinder. The draw hook is held locked in the engaged position by self-locking clamping devices mounted on the support body. All together, in this solution, the supporting trunnion is locked indirectly by the bearing bushing bolting piece and the draw hook that acts on it. Due to its dimensions, this mounting system requires a large lifting height, i.e., a generous amount of clearance above the converter.

In another embodiment according to DE 25 11 610 A1, the converter has claw-like brackets joined with the converter wall as bearing elements instead of the supporting trunnions and the bearing bushings. The brackets have inclined surfaces, with which the hook ends of the draw hooks can be engaged and disengaged. The undersides of the brackets are flat. They lie on the flat upper side of the support body. This is associated with the disadvantage of insecure clamping.

Accordingly, the objective of the invention is to create a converter with a mounting system for a support body which eliminates the disadvantages of the previously known systems. It must be possible to clamp the converter securely on the supporting trunnion and to connect the lines for the process gases securely on the converter.

In particular, the invention proposes that the support brackets and a mounting area of the support body or trunnion ring that receives each support bracket are suitably configured relative to each other in such a way that the support bracket is securely guided and fixed when mechanical and/or thermal movements occur.

The converter vessel is securely held by an automatically operated lever clamping system, especially a lever clamping system that can be hydraulically operated on one side, in combination with a compact vessel guide with a low design. In the opened state of the clamping lever system, the converter is to be lifted only by the amount that is necessary for it to come safely out of the vessel guide.

The automatic mounting system consists essentially of two components. First, clamping means or a hydraulically operated single-action clamping lever, which describes a rotational movement by means of a lifting cylinder, is integrated in the support body or trunnion ring. Second, each support bracket has an integrated vessel guiding and/or vessel fixing shape, such that the support bracket tapers towards its underside and/or outside. This vessel guiding and/or vessel fixing shape is preferably conical. This guide serves the purpose of securely guiding and/or fixing the vessel relative to the support body during thermal expansion and tilting movements, i.e., during thermal and mechanical movements. A connection that is both secure and releasable is thus produced between the support body and the converter vessel. The clamping lever is swiveled by the support brackets and in its end position presses the brackets securely against the support body.

In accordance with a preferred variant, independent release of the clamping lever is prevented by an automatic self-locking mechanism.

The support brackets in the support body are reliably guided into their working position both in the axial direction and in the tangential and radial direction and are fixed during operation.

As described earlier, it is not merely necessary to lift the metallurgical vessel out of the support body and insert it again. In this operation, it is also necessary to make sure that the lines that convey the process gases and inert gases to the converter are reliably detached from the vessel and later reattached to the vessel. Therefore, the invention also proposes a coupling device for automatically disconnecting and connecting the media supply system that supplies process gases and/or inert gases for the vessel. This device comprises a first coupling component or male part on the support body and a second coupling component or female part on the converter or in the converter wall with sealing elements and a coupling mechanism relative to the first coupling component.

To be able to compensate variable distances between the support body and converter vessel, for example, due to different thermal expansions, the coupling components are designed to be self-centering relative to each other. In this way, a secure connection is always guaranteed.

Further details and advantages of the invention are apparent from the following description, in which the specific embodiments of the invention illustrated in the drawings are explained in greater detail. The invention includes not only the combinations of features described above but also the described features alone or in other combinations.

Figure 1:
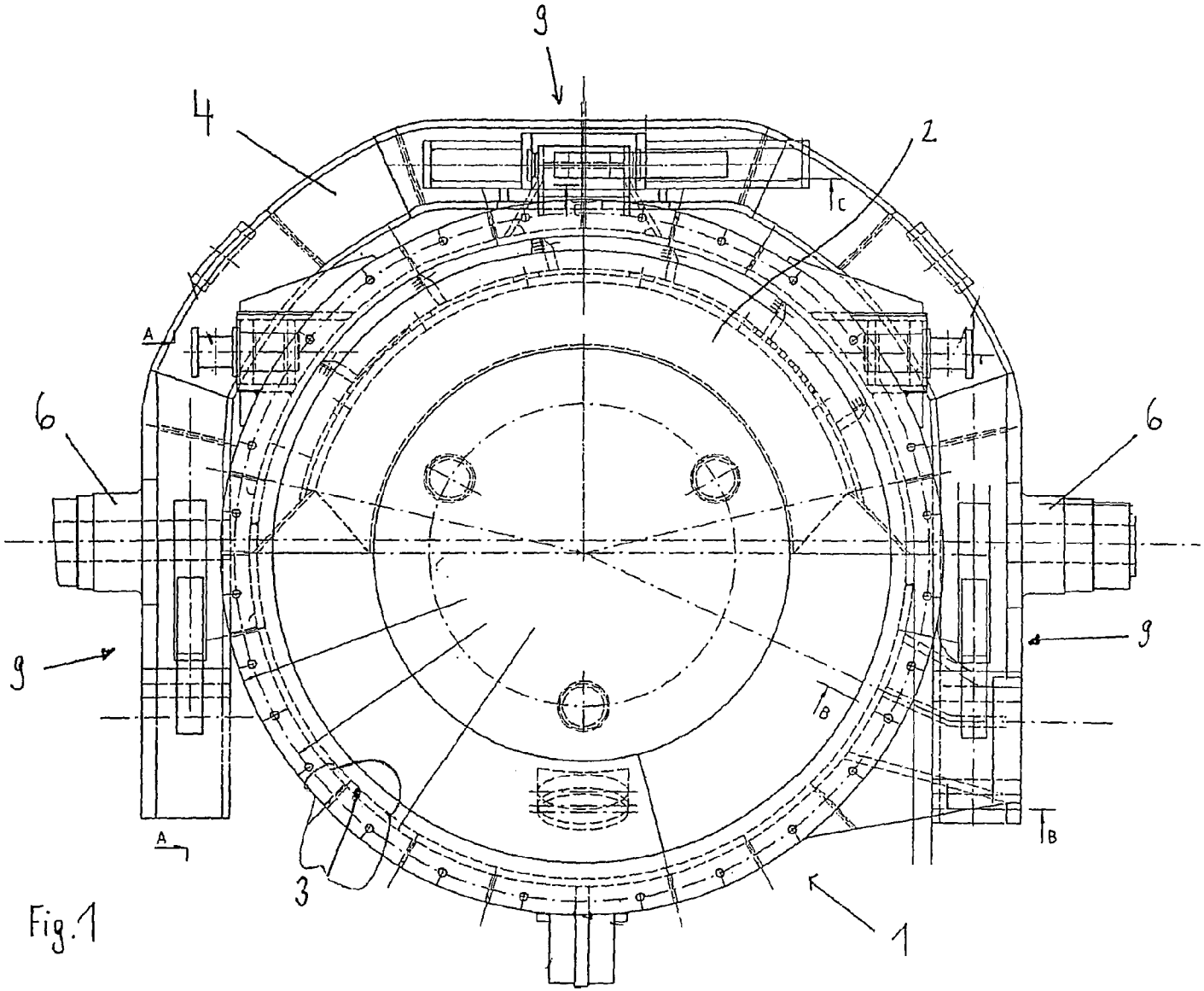
FIG. 1 shows a top view of a converter vessel with a support body or trunnion ring and an automatic mounting system.

The tiltable metallurgical vessel 1 shown in FIG. 1 is a converter 2 for producing steel. The vessel wall 3 is protected with refractory material. The converter 2 is supported by a support body 4, hereinafter referred to as the trunnion ring, which in the present case extends around the vessel wall 3 in the form of a "U".

Figure 2:
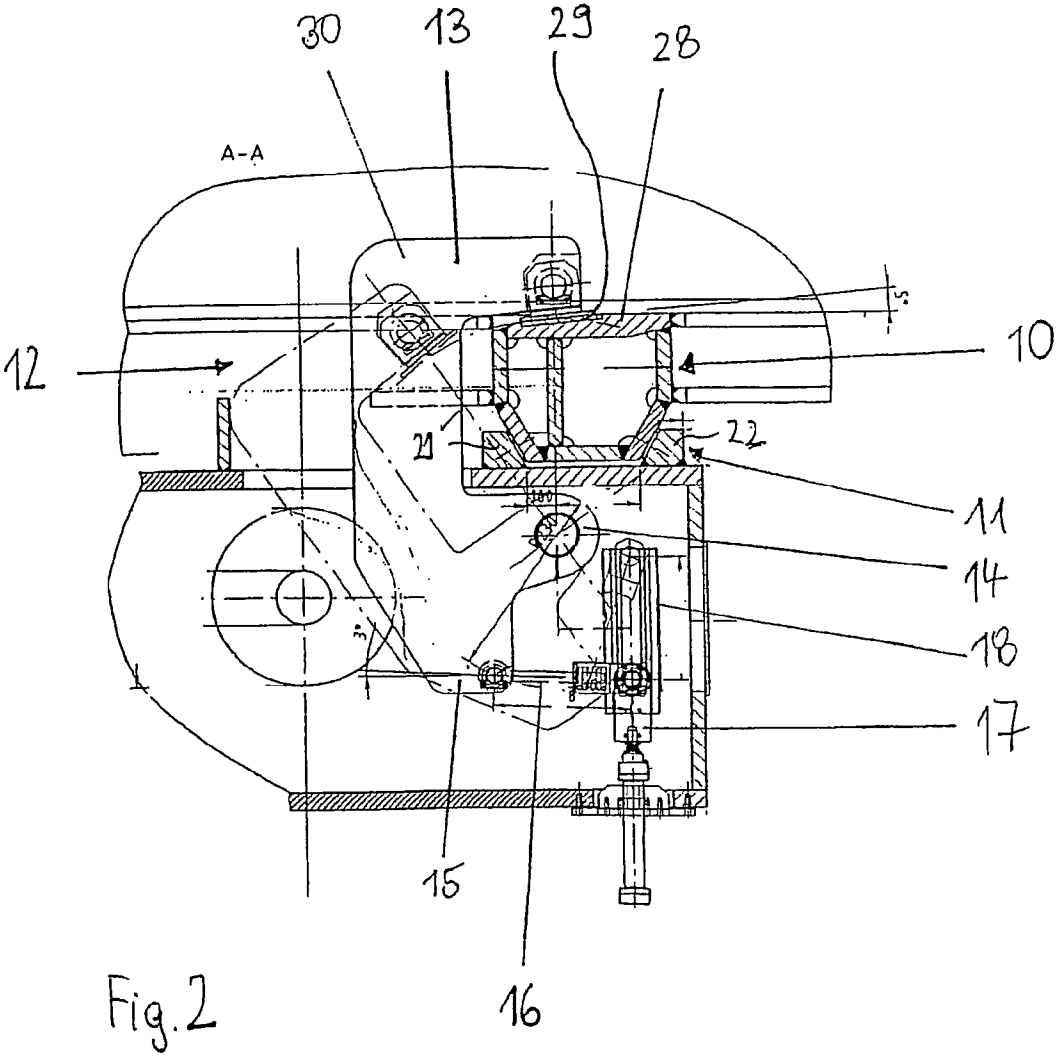
FIG. 2 shows sectional view A-A of FIG. 1.
Figure 3:
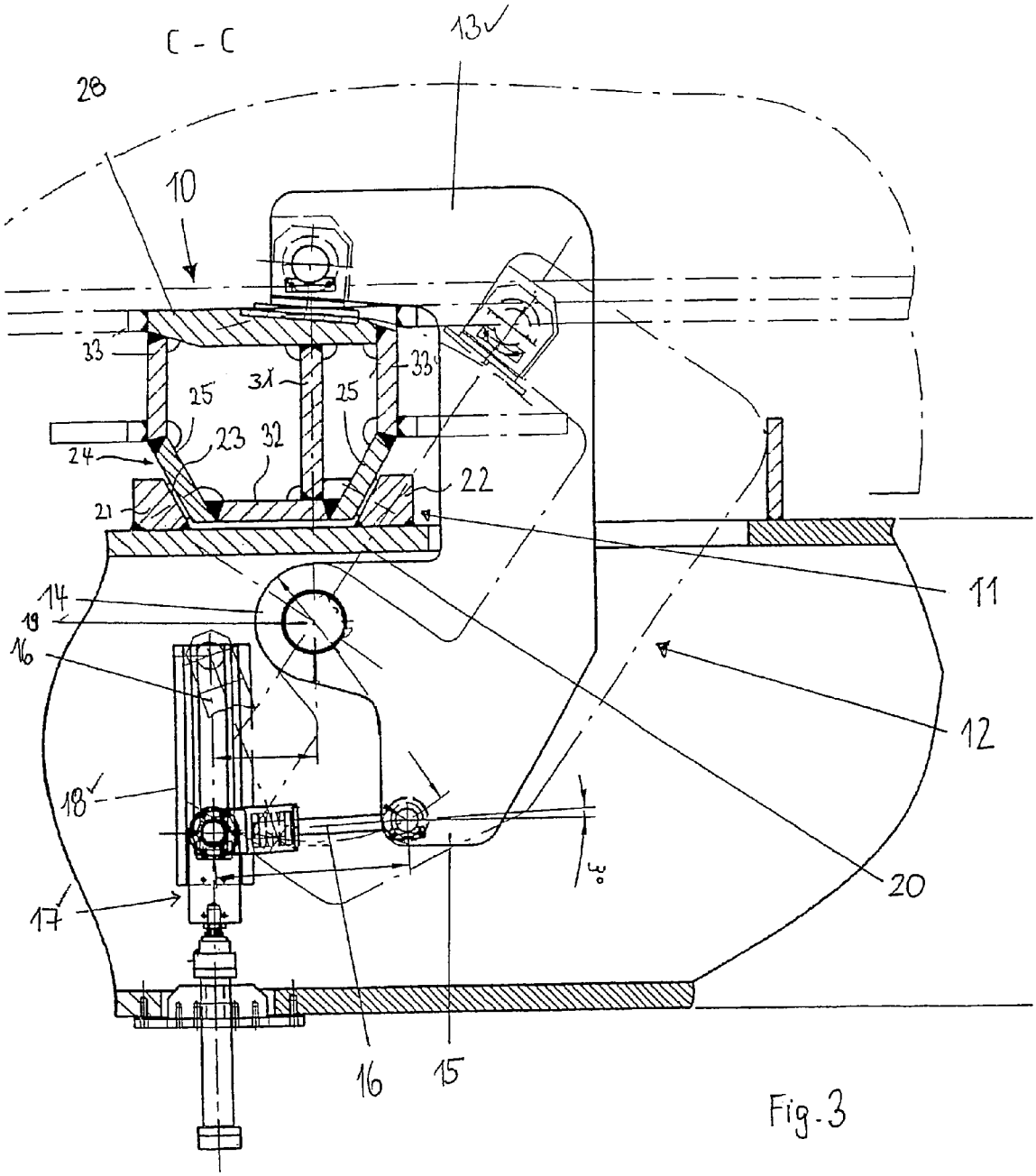
FIG. 3 shows sectional view C-C of FIG. 1.

The converter 2 is held on the trunnion ring 4 by an automatic mounting system 9, which in the present case is formed on three sides of the converter. One side of the trunnion ring 4 is left open to allow the converter 2 to be moved in and out. To allow the converter 2 to be mounted, three support brackets 10 are arranged on the vessel wall 3 of the converter 2. The support brackets 10 rest in a suitably configured mounting area 11 of the trunnion ring 4. FIGS. 2 and 3 show details of the automatic mounting system 9, the support brackets 10, and the mounting area 11 of the trunnion ring 4.

The automatic mounting system 9 comprises clamping means 12 in the form of a clamping lever 13 that embraces the respective support brackets 10 on one side. This clamping lever 13 is rotatably supported on a first lower arm 14. The clamping lever 13 is connected with a hydraulic pressure unit 17 by a second lower arm 15 and a coupling element 16 that can be swiveled. The piston of the hydraulic pressure unit 17 can be moved along a guide 18 and rotates the clamping lever 13 about a swivel bearing 19. The dot-dash line indicates the clamping lever 13 in an opened position, and the solid line indicates the clamping lever 13 in its engaged position or clamping position. The clamping lever 13 is mounted on the trunnion ring 4 by the swivel bearing 19 and the hydraulic pressure unit 17.

A groove-like mounting area 11 for the support brackets 10 of the converter 2 is formed on the upper side 20 (see FIG. 3) of the trunnion ring 4 itself. To this end, suitable blocks 21, 22 with sloped inner surfaces 23 are welded on the upper side 20 of the trunnion ring. The support bracket 10 on the converter vessel has a lower bracket region 24 that fits the groove-like mounting area 11. This lower bracket region 24 tapers downward in conformity with the shape of the mounting area 11 of the trunnion ring. Due to this vessel guiding and fixing shape, the support bracket 10 is securely tangentially guided and fixed in the trunnion ring 4, even when mechanical and/or thermal movements occur.

Figure 4:
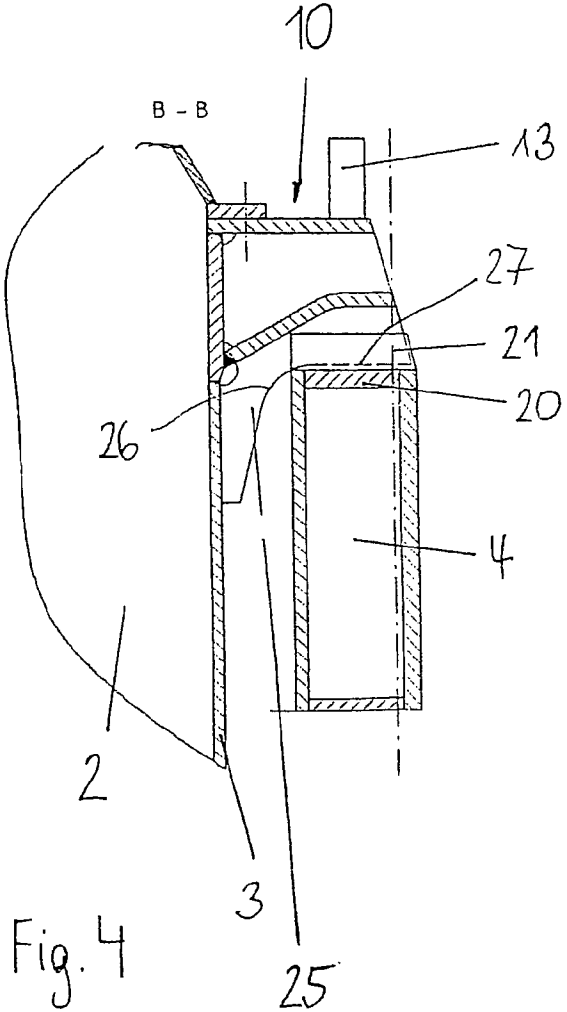
FIG. 4 shows sectional view B-B of FIG. 1.

FIG. 4, which shows section B-B according to FIG. 1, illustrates the shape of the projecting support brackets 10, which guarantees radial fixation of the converter 2 on the trunnion ring 4. The lateral lower side plates 25 of the support brackets 10 taper not only toward their underside but also toward their outside. They run like a collar with an initially sharp curvature 26 into a flat region 27, which comes to rest on the flat upper side 20 of the trunnion ring 4 and is fixed laterally by the blocks 21, 22.

If the support bracket 10 is located in this predetermined position or fixing position, the clamping lever 13 automatically swivels out of its opened position along the indicated circular arc (see FIG. 2) into its clamping position. To this end, the upper side or top plate 28 of the support bracket 10 has a surface 29 that conforms to the circular arc, so that the upper clamping arm 30 of the clamping lever 13 comes securely to rest. In this clamping position, the clamping lever 13 can be swiveled further, so that self-locking is produced.

In the embodiment shown here, the support bracket 10 itself is welded together from a plate construction in order to bring about the desired configuration with respect to the lower support bracket region 24 (see especially FIG. 3). The support bracket 10 has an upper plate 28, a base plate 32, two vertical side plates 33, and two lateral lower side plates 25. The support bracket 10 is supported in the area of the working surface of the clamping lever by an additional central plate 31. The invention also encompasses other variants, for example, cast or forged support brackets.

Figure 5:
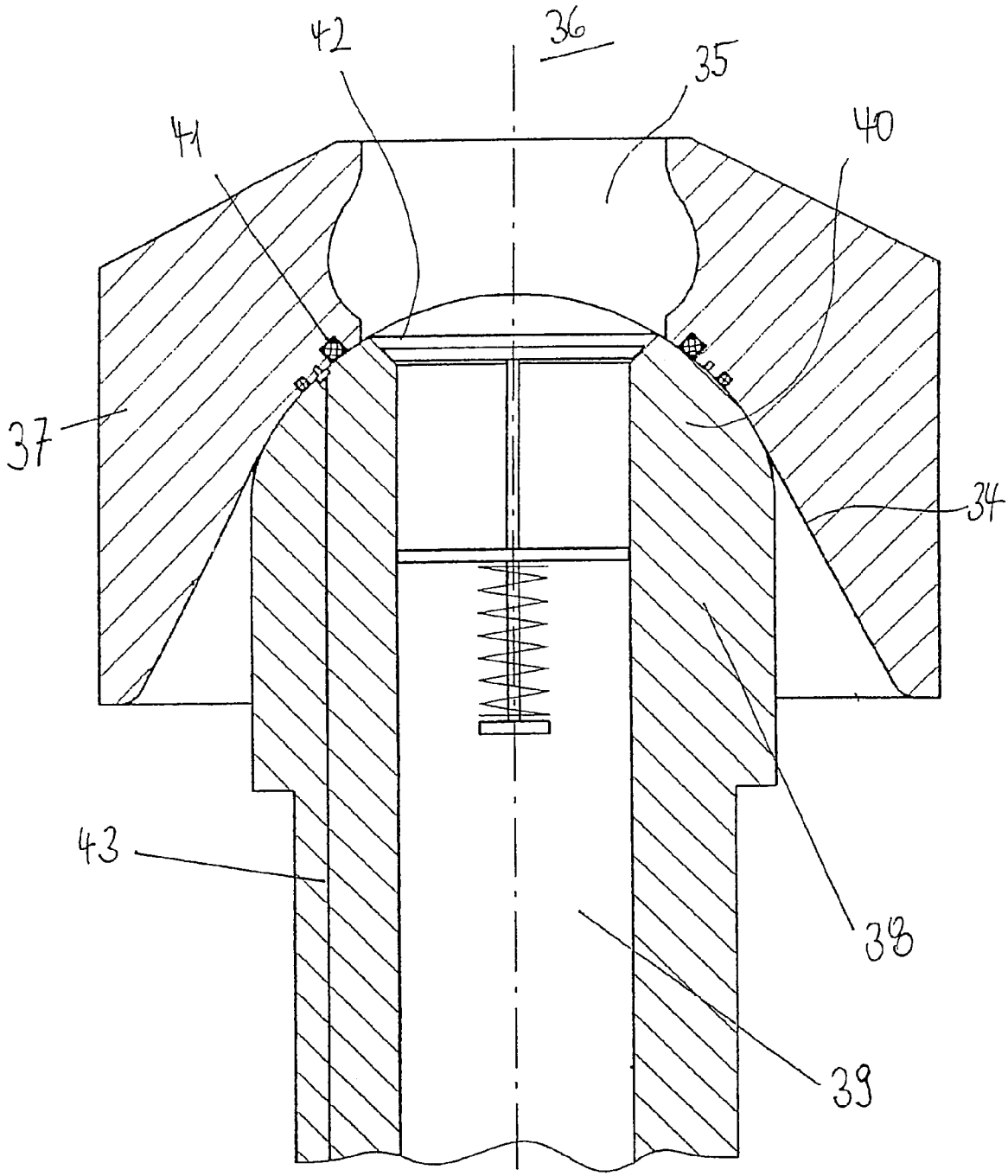
FIG. 5 shows a section through a coupling device of the invention for disconnecting and connecting the media supply lines for the process gases and inert gases for the tuyeres.

The proposed invention thus creates a converter 2 with an automatic mounting system 9, which produces optimum efficiency even in the event of thermal fluctuations. At the same time, a coupling device is proposed, which allows optimum disconnection of the supply system during a converter change and at the same time can compensate thermal fluctuations during operation. This coupling device is shown in FIG. 5. A second coupling component 37 with a concave arch 34 is mounted on the vessel wall 3. It is connected by a passage 35 with pipelines/hoses that run to the process gas tuyeres. This construction on the vessel wall 3 forms a second coupling component 37, while the first coupling component 38 is mounted on the trunnion ring 4. The first coupling component 38 has an axial flow region 39 and a tip 40 that is curved to conform to the concave curvature of the second coupling component 37. A seal is achieved by sealing elements 41 on the second coupling component 37. In a sealed coupling or in the operating position, a disk 42 opens the flow region 39, and the process gases can be fed into the converter through pipelines/hoses that run to the process tuyeres. A pressure measurement system 43 immediately detects and displays any gas leakages that may occur.

All together, the invention creates an automatic vessel mounting system with automatic process gas coupling for converter systems with process gas tuyeres. The changing of a metallurgical vessel is greatly simplified, because the manual disconnection of the usual vessel mounting elements is eliminated. In addition, automatic disconnection/connection of the process gas and inert gas supply without manual action is ensured. The changing times for metallurgical exchange vessels are greatly reduced. Furthermore, the invention ensures that no operating personnel will have to work on the converter support body or trunnion ring or in the immediate vicinity of the vessel, which is desirable due to the otherwise poor and dangerous accessibility.

LIST OF REFERENCE NUMBERS

1 metallurgical vessel
2 converter
3 vessel wall
4 support body or trunnion ring
6 support trunnion
9 automatic mounting system
10 support brackets
11 mounting area of the trunnion ring
12 clamping means
13 clamping lever

14 first lower arm of the clamping lever
15 second lower arm of the clamping lever
16 coupling element
17 hydraulic pressure unit with cylinder
18 guide
19 swivel bearing
20 upper side of the trunnion ring
21 block
22 block
23 inner surface of the blocks
24 lower support bracket region
25 lateral lower side plates of the support bracket
26 curvature of the lateral lower side plates
27 flat region of the lateral lower side plates
28 upper side or upper plate of the support bracket
29 working surface of the clamping lever
30 upper clamping arm of the clamping lever
31 support plate
32 base plate
33 side plate
34 concave arch
35 axial flow region
37 second coupling component
38 first coupling component
39 axial flow region
40 tip of the first coupling component
41 sealing elements
42 disk
43 pressure measurement system

The invention claimed is:

1. A metallurgical vessel (1), comprising support brackets (10) mounted on a vessel wall (3), where the support brackets (10) are mounted by a mounting system (9) on a support body (4) that does not completely surround the circumference of the vessel, where the mounting system (9) comprises clamping means (12) that act on the support brackets (10), where the vessel (1) can be disconnected from the support body (4) and later reconnected to the support body if the clamping means (12) are not in the engaged position, and a coupling device is provided, which has a first coupling component (38) mounted on the support body (4) and a second coupling component (37) mounted on the vessel wall (3), wherein the first and second coupling components are configured and arranged so as to automatically engage when the clamping means is in the engaged position and to automatically disengage when the clamping means are not in the engaged position, for automatically disconnecting from the vessel (1) a media supply system that supplies process gases and/or inert gases when the vessel (1) is disconnected from the support body (4), and for automatically reconnecting the media supply system to the vessel (1) when the vessel is reconnected to the support body (4), wherein the coupling device has sealing elements (41) and a coupling mechanism of the first coupling component (38) relative to the second coupling component (37), and wherein the first coupling component is designed as a male part and the second coupling component as a female part.

2. A metallurgical vessel in accordance with claim 1, wherein the support brackets (10) and a mounting area (11) of the support body (4) that receives each support bracket are suitably configured relative to each other in such a way that each support bracket (10) is securely guided and fixed when mechanical and/or thermal movements occur.

3. A metallurgical vessel in accordance with claim 2, wherein the shape of the support brackets (10) and the shape of the mounting area (11) of the support body (4) are formed in such a way that the support brackets (10) are securely fixed radially and/or tangentially.

4. A metallurgical vessel in accordance with claim 1, wherein the support bracket (10) has an integrated vessel guiding and/or vessel fixing shape that tapers towards a lower support bracket region (24).

5. A metallurgical vessel in accordance with claim 1, wherein the support bracket (10) has an integrated vessel guiding and/or vessel fixing shape that tapers towards the outside.

6. A metallurgical vessel in accordance with claim 1, wherein the support bracket (10) has an integrated vessel guiding and/or vessel fixing shape that is conical.

7. A metallurgical vessel in accordance with claim 2, wherein the mounting area (11) of the support body (4) has a grooved design in order to fix the support bracket (10) tangentially.

8. A metallurgical vessel in accordance with claim 1, wherein the clamping means (12) are provided with a self-locking mechanism.

9. A metallurgical vessel in accordance with claim 1, wherein the two coupling components (38, 37) of the process gas and/or inert gas coupling are designed to be self-centering.

10. A metallurgical vessel in accordance with claim 1, wherein the sealing elements (41) are connected with a pressure measurement system (43) that detects and displays any gas leakages that may occur.

11. A metallurgical vessel in accordance with claim 1, wherein a flow region (39) of the first coupling component (38) is protected by a disk (42) from the penetration of foreign bodies in the uncoupled state.

* * * * *